US007987559B2

(12) United States Patent
Chou

(10) Patent No.: US 7,987,559 B2
(45) Date of Patent: Aug. 2, 2011

(54) HINGE ASSEMBLY WITH RESTRICTING UNIT

(75) Inventor: Yu-Cheng Chou, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 295 days.

(21) Appl. No.: 12/337,765

(22) Filed: Dec. 18, 2008

(65) Prior Publication Data

US 2010/0095486 A1 Apr. 22, 2010

(30) Foreign Application Priority Data

Oct. 17, 2008 (CN) ..... 2008 1 0304965

(51) Int. Cl.
*E05D 3/10* (2006.01)

(52) U.S. Cl. ..... 16/367; 16/342; 16/371

(58) Field of Classification Search ..... 16/367, 16/343, 342, 374, 371, 366; 379/433.13; 455/575.3; 361/679.27, 679.06; 248/923
See application file for complete search history.

(56) References Cited

U.S. PATENT DOCUMENTS 7,155,781 B2 * 1/2007 Yamada et al. ..... 16/367
7,513,013 B2 * 4/2009 Hsieh ..... 16/367
7,743,468 B2 * 6/2010 Chang et al. ..... 16/374
7,797,797 B2 * 9/2010 Chiang et al. ..... 16/367
7,823,255 B2 * 11/2010 Wang et al. ..... 16/367
2008/0000050 A1 * 1/2008 Hsu ..... 16/367
2008/0034545 A1 * 2/2008 Shieh ..... 16/367
2008/0271293 A1 * 11/2008 Hsu et al. ..... 16/367
2010/0005626 A1 * 1/2010 Wang et al. ..... 16/367

* cited by examiner

*Primary Examiner* — William L. Miller
(74) *Attorney, Agent, or Firm* — Clifford O. Chi

(57) ABSTRACT

An exemplary hinge assembly includes a mounting bracket, a rotatable bracket, a swivel mechanism, and two pivot mechanisms. The rotatable bracket defines a sliding groove. The swivel mechanism connects the mounting bracket to the rotatable bracket. The rotating subassembly has a rotating shaft, a first restricting member, and a second restricting member. The first restricting member is rotatably connected to the rotating shaft, and the second restricting member is non-rotatably connected to the rotating shaft. The first restricting member has a restricting portion and a first resisting portion. The restricting portion is movably received in the sliding groove. The second restricting member includes a restricting protrusion. The restricting protrusion is capable of driving the first resisting portion together with the first restricting member to rotate in the sliding groove until the restricting portion reaches an end of the sliding groove.

16 Claims, 6 Drawing Sheets

HINGE ASSEMBLY WITH RESTRICTING UNIT

BACKGROUND

1. Technical Field

The present disclosure relates generally to hinge assemblies and, more particularly, to a hinge assembly with a restricting unit.

2. Description of the Related Art

An electronic device such as a mobile phone, a notebook computer, or a personal digital assistant (PDA) commonly has a main body and a cover. The cover has a display, and is pivotally mounted on the main body via a hinge assembly.

The hinge assembly includes a first bracket, a second bracket, a swivel mechanism, and two pivot mechanisms. A bottom end of the swivel mechanism is perpendicularly and movably attached to the middle of the first bracket. An opposite top end of the swivel mechanism is fixedly attached to the middle of the second bracket. The pivot mechanisms are horizontally positioned at opposite ends of the second bracket. The bottom end of the swivel mechanism includes a restricting member. A restricting portion is formed at an edge of the restricting member. A limiting protrusion extends from the first bracket adjacent to the swivel mechanism. The restricting portion and the limiting protrusion cooperatively define a range of angles of rotation of the second bracket relative to the first bracket. In use, the first bracket is connected to the main body, and the pivot mechanisms are connected to the cover. The first bracket is also known as a mounting bracket, and the second bracket is also known as a rotatable bracket.

The rotation angle range between the rotatable bracket and the mounting bracket is defined and limited by the restricting portion of the restricting member and the limiting protrusion of the mounting bracket. Typically, the cover connected to the pivot mechanisms cannot rotate through fully 360 degrees relative to an axis of the swivel mechanism. That is, an electronic device utilizing the hinge assembly may not be convenient to use.

Therefore, a hinge assembly to solve the aforementioned problems is desired.

SUMMARY

A hinge assembly includes a mounting bracket, a rotatable bracket, a swivel mechanism, and two pivot mechanisms. The rotatable bracket defines a sliding groove. The swivel mechanism connects the mounting bracket to the rotatable bracket. The rotating subassembly has a rotating shaft, a first restricting member, and a second restricting member. The first restricting member is rotatably connected to the rotating shaft, and the second restricting member is non-rotatably connected to the rotating shaft. The first restricting member has a restricting portion and a first resisting portion. The restricting portion is movably received in the sliding groove. The second restricting member includes a restricting protrusion. The restricting protrusion is capable of driving the first resisting portion together with the first restricting member to rotate in the sliding groove until the restricting portion reaches an end of the sliding groove.

Other advantages and novel features will become more apparent from the following detailed description when taken in conjunction with the accompanying drawings.

BRIEF DESCRIPTION OF THE DRAWINGS

The components in the drawings are not necessarily drawn to scale, the emphasis instead being placed upon clearly illustrating the principles of the present hinge assembly. Moreover, in the drawings, like reference numerals designate corresponding parts throughout the several views.

DETAILED DESCRIPTION OF EMBODIMENTS

Reference will now be made to the drawings to describe embodiments of the present hinge assembly, in detail.

Figure 1:
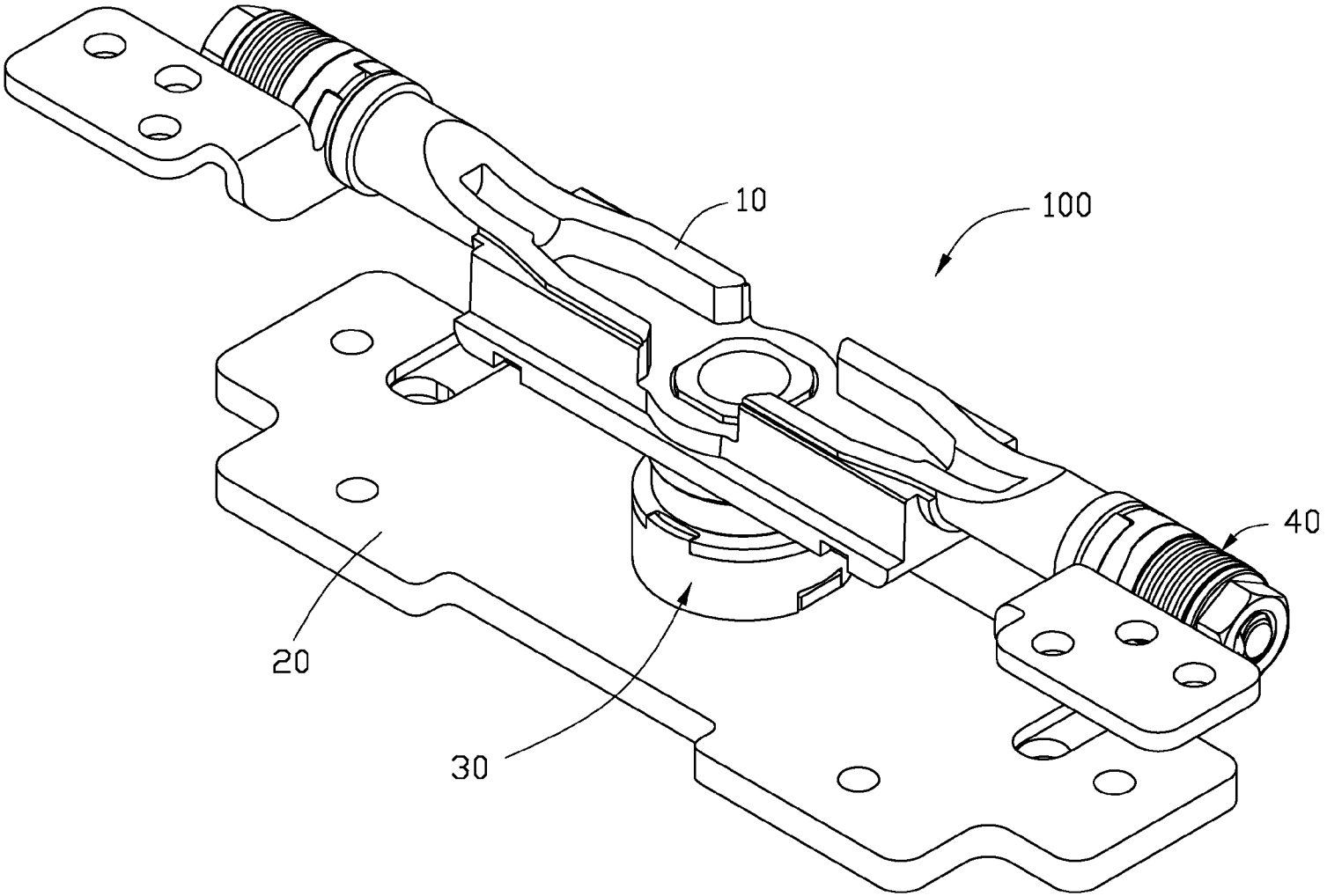
FIG. 1 is an assembled, isometric view of a hinge assembly according to an exemplary embodiment of the present disclosure, the hinge assembly including a mounting bracket, a rotatable bracket, a swivel mechanism, and two pivot mechanisms.

Referring to FIG. 1, a hinge assembly 100 of an exemplary embodiment includes a rotatable bracket 10, a mounting bracket 20, a swivel mechanism 30, and two pivot mechanisms 40. The swivel mechanism 30 connects the rotatable bracket 10 to the mounting bracket 20. The pivot mechanisms 40 are positioned on opposite ends of the rotatable bracket 10.

Figure 2:
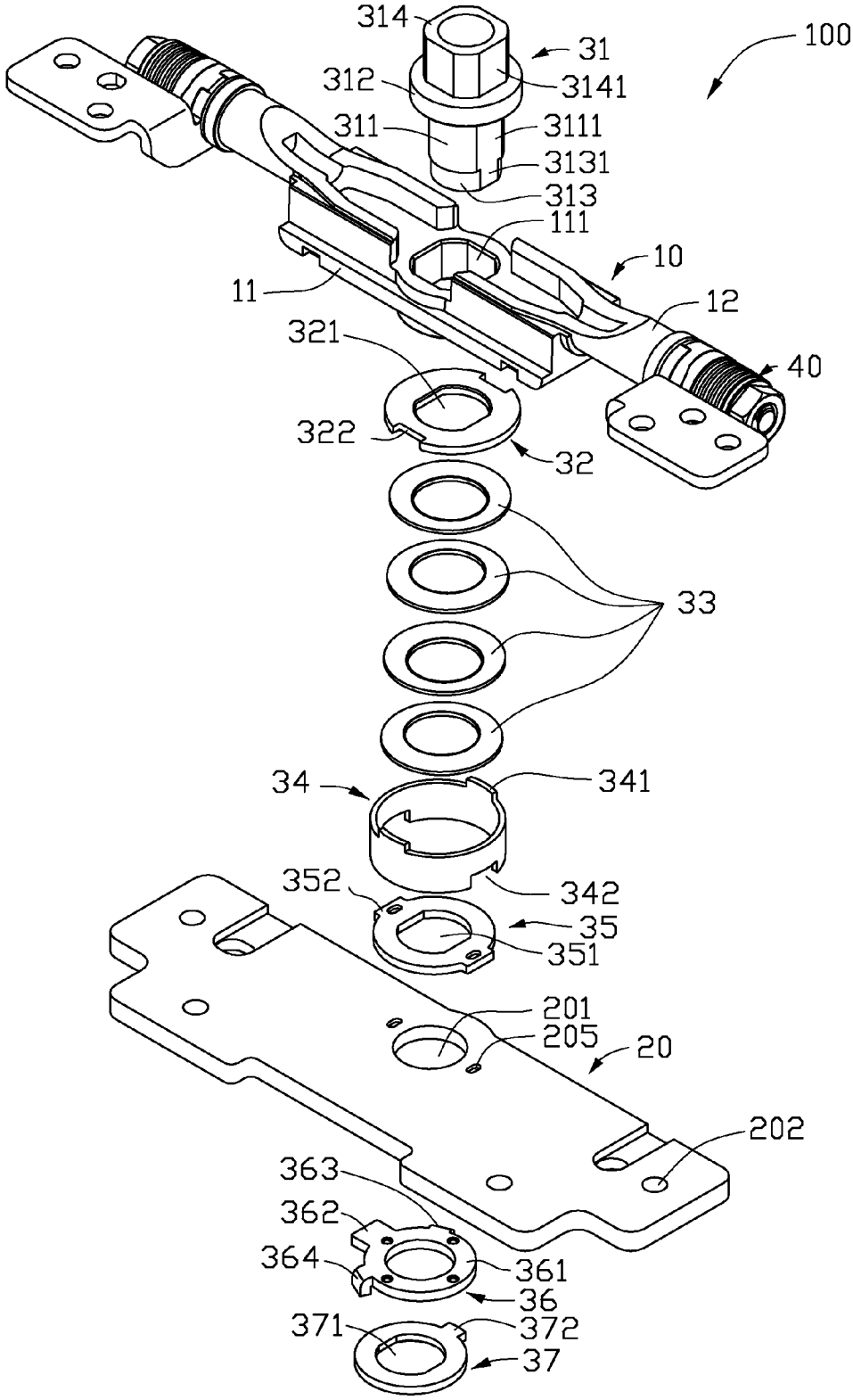
FIG. 2 is an exploded, isometric view of the hinge assembly of FIG. 1.
Figure 3:
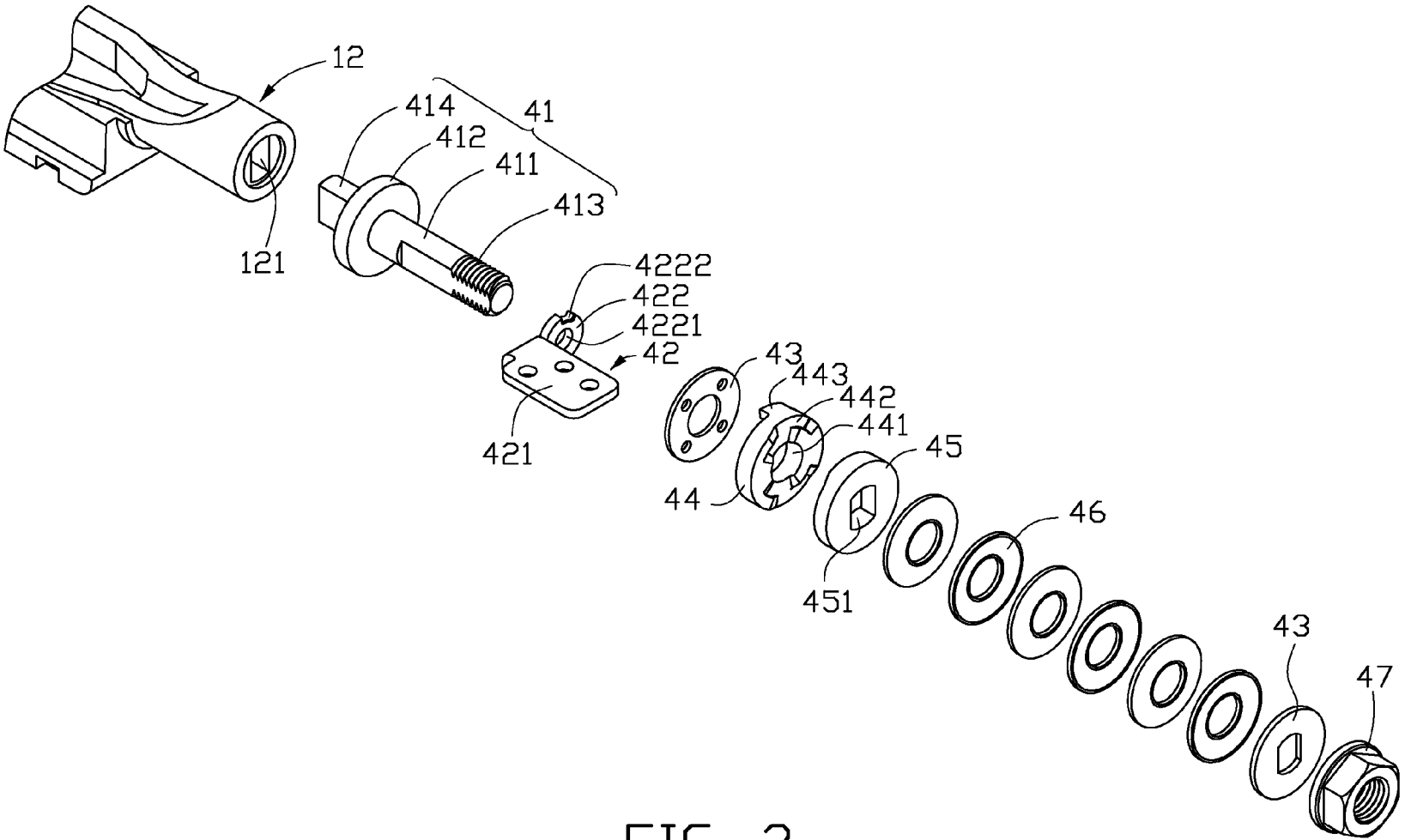
FIG. 3 is an exploded, isometric view of part of the mounting bracket and one of the pivot mechanisms of FIG. 1.
Figure 4:
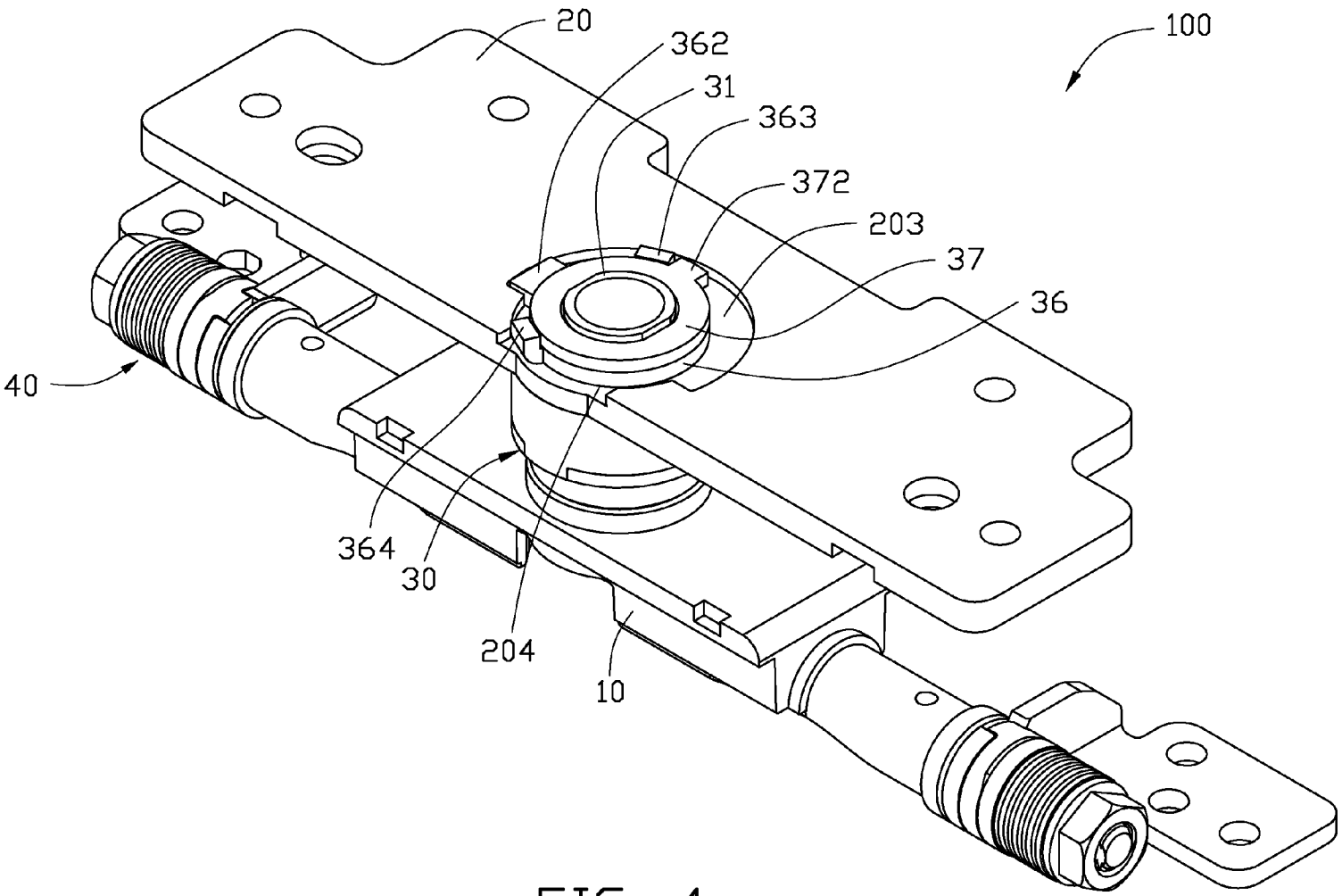
FIG. 4 is an isometric view of the hinge assembly of FIG. 1, but showing the hinge assembly inverted.

Referring also to FIGS. 2 through 4, the rotatable bracket 10 includes a rectangular base portion 11. A center of the base portion 11 defines a through hole 111 configured for engagement of the swivel mechanism 30 therein. Two connecting portions 12 are formed on opposite ends of the base portion 11. Each connecting portion 12 defines an assembling hole 121 along an axis thereof. The assembling hole 121 is configured for receiving a respective one of the pivot mechanisms 30 therein.

The mounting bracket 20 can be substantially rectangular. The mounting bracket 20 defines a circular through hole 201 in a middle portion thereof, and a plurality of fixing holes 202 near edges thereof. The mounting bracket 20 also defines two positioning grooves 205 at a top surface thereof, at opposite sides of the through hole 201. The mounting bracket 20 further defines a sliding groove 203 and a cutout 204 at a bottom surface thereof, around the through hole 201. The sliding groove 203 is generally circular, but also includes a peripheral portion that is substantially semicircular. It is essentially the peripheral portion that provides a sliding function in operation of the swivel mechanism 30.

The swivel mechanism 30 includes a rotating shaft 31, a first washer 32, a plurality of spring washers 33, a sleeve 34, a second washer 35, a first restricting member 36, and a second restricting member 37. The rotating shaft 31 includes a shaft portion 311. An annular flange 312 is formed at a first end of the shaft portion 311, and an assembling portion 313 is formed at an opposite second end of the shaft portion 311. An insertion portion 314 is formed at a surface of the flange 312 that is farthest away from the shaft portion 311. The shaft portion 311 is substantially hollow cylindrical shaped, and defines two positioning planes 3111 at opposite sides of an outer surface thereof. The assembling portion 313 is substantially hollow cylindrical shaped, and defines two positioning planes 3131 at opposite sides of an outer surface thereof. In the illustrated embodiment, the positioning planes 3111 are coplanar with the positioning planes 3131. The insertion portion 314 is configured for engaging in the through hole 111, and defines four positioning planes 3141 at an outer surface thereof. The first washer 32 defines a connecting hole 321 corresponding to the shaft portion 311. The first washer 32 also defines two cutouts 322 at opposite outer sides thereof. The sleeve 34 defines two positioning cutouts 342 at opposite sides of a first end thereof. Two positioning pieces 341 are formed on opposite sides of an opposite second end of the sleeve 34. A center of the second washer 35 defines a connecting hole 351 corresponding to the shaft portion 311. Two restricting tabs 352 are formed on opposite outer sides of the second washer 35. Two protrusions (not visible) extend from a bottom surface of the second washer 35.

The first restricting member 36 includes a main portion 361. The main portion 361 is a circular ring. A restricting portion 362 radially extends from an outer edge of the main portion 36. A first resisting portion 363 and a second resisting portion 364 perpendicularly extend from peripheral edges of the main portion 36. An angle between the first resisting portion 363 and the second resisting portion 364 as measured from a center of the main portion 36 is about 120 degrees. A center of the second restricting member 37 defines a connecting hole 371 corresponding to the shaft portion 371. A restricting protrusion 372 radially extends from an outer edge of the second restricting member 37.

Each pivot mechanism 40 includes a connecting shaft 41, a connecting frame 42, two washers 43, a cam follower 44, a cam 45, a plurality of spring washers 46, and a fastening member 47. The connecting shaft 41 includes a shaft portion 411. An annular flange 412 is formed at a first end of the shaft portion 411, and a threaded portion 413 is formed at an opposite second end of the shaft portion 411. An insertion portion 414 is formed at a surface of the flange 412 that is farthest away from the shaft portion 411. The insertion portion 414 is configured for engaging in the assembling hole 121 of the corresponding connecting portion 12. The connecting frame 42 includes a fixing piece 421, and a connecting piece 422 perpendicularly extending from an end of the fixing piece 421. A center of the connecting piece 422 defines a circular hole 4221. The connecting piece 422 defines a restricting cutout 4222 in an outer edge thereof. A center of the cam follower 44 defines a circular connecting hole 441 corresponding to the shaft portion 411. Two valleys 442 are defined in a first end of the cam follower 44. A restricting protrusion 443 extends from an edge of an opposite second end of the cam follower 44. The restricting protrusion 443 is configured for engaging in the restricting cutout 422 of the connecting frame 42. A center of the cam 45 defines a connecting hole 451, corresponding to the shaft portion 411. The connecting hole 451 is shaped to match a shape of a transverse cross-section of the shaft portion 411. Two peaks (not shown) are formed on one end of the cam 45.

In assembling the hinge assembly 100, the shaft portion 311 of the rotating shaft 31 is extended through the first washer 32, the spring washers 33, the sleeve 34, the second washer 35, the mounting bracket 20, and the first restricting member 36. After that, the second restricting member 37 is (for example) riveted on the assembling portion 313 of the rotating shaft 31. The insertion portion 314 is engaged in the through hole 111 of the rotatable bracket 10. Each positioning piece 341 of the sleeve 34 engages in a corresponding cutout 322 of the first washer 32. Each restricting tab 352 of the second washer 35 engages in a corresponding positioning cutout 342 of the sleeve 34. The protrusions (not visible) of the second washer 35 engage in the positioning grooves 205 of the mounting bracket 20. The first restricting member 36 is received in the sliding groove 203 of the mounting bracket 20. For one of the pivot mechanisms 40, the threaded portion 413 of the connecting shaft 41 is extended through one of the washers 43, the cam follower 44, the cam 45, the spring washers 46, and the other washer 43, and the fastening member 47 is engaged on the threaded portion 413. The insertion portion 414 of the connecting shaft 41 is engaged in the assembling hole 121 of one of the connecting portions 12 of the rotatable bracket 10. The other pivot mechanism 40 is assembled and attached to the other connecting portion 12 of the rotatable bracket 10 according to the above-described assembling steps. After that, the rotatable bracket 10 can rotate with the rotating shaft 31 relative to the mounting bracket 20, and each connecting frame 42 can rotate about the corresponding connecting shaft 41 relative to the rotatable bracket 10.

Figure 5:
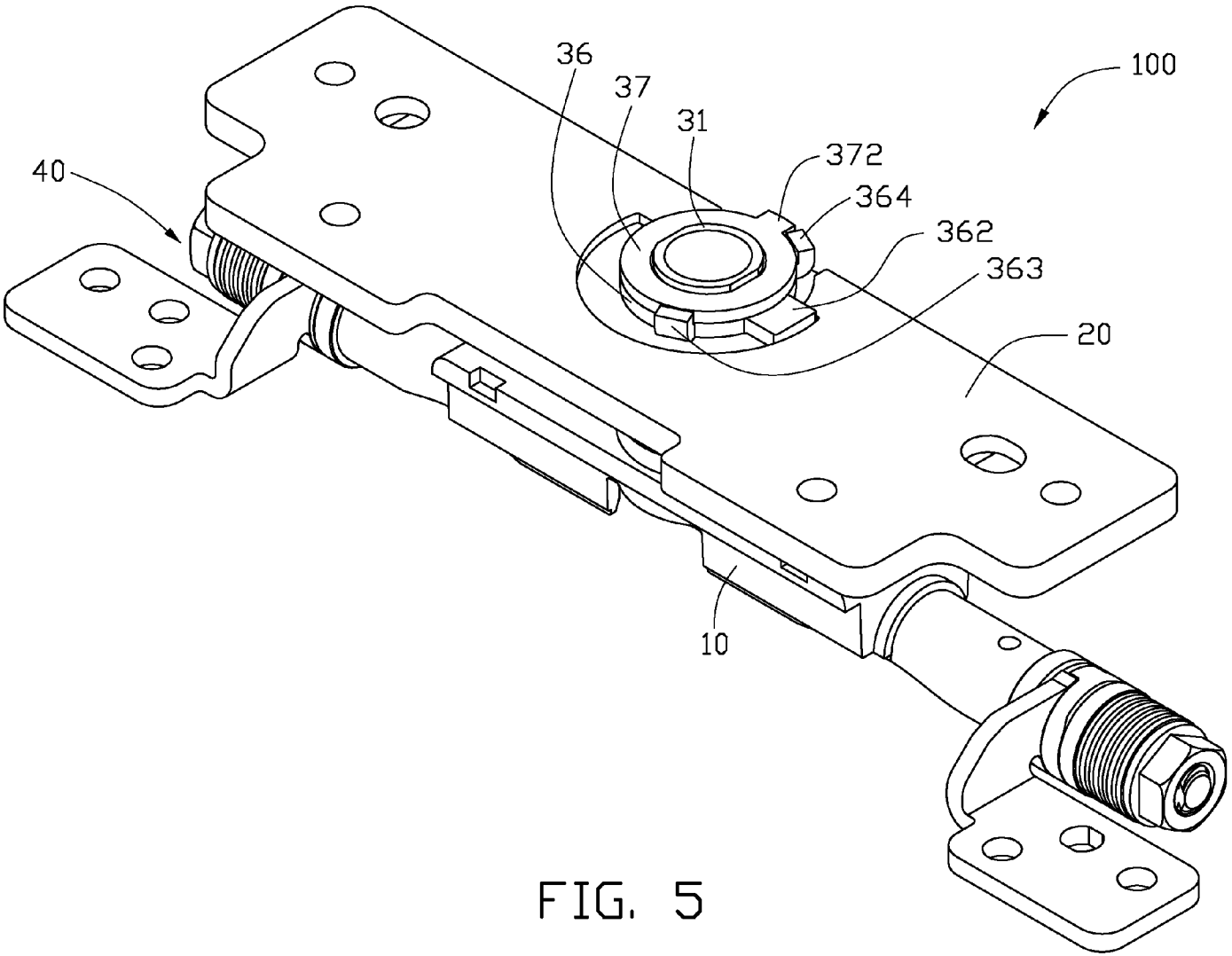
FIG. 5 is an isometric view of the hinge assembly of FIG. 4, but viewed from another aspect, and showing the state of the hinge assembly after the rotatable bracket has been rotated 180 degrees relative to the mounting bracket.
Figure 6:
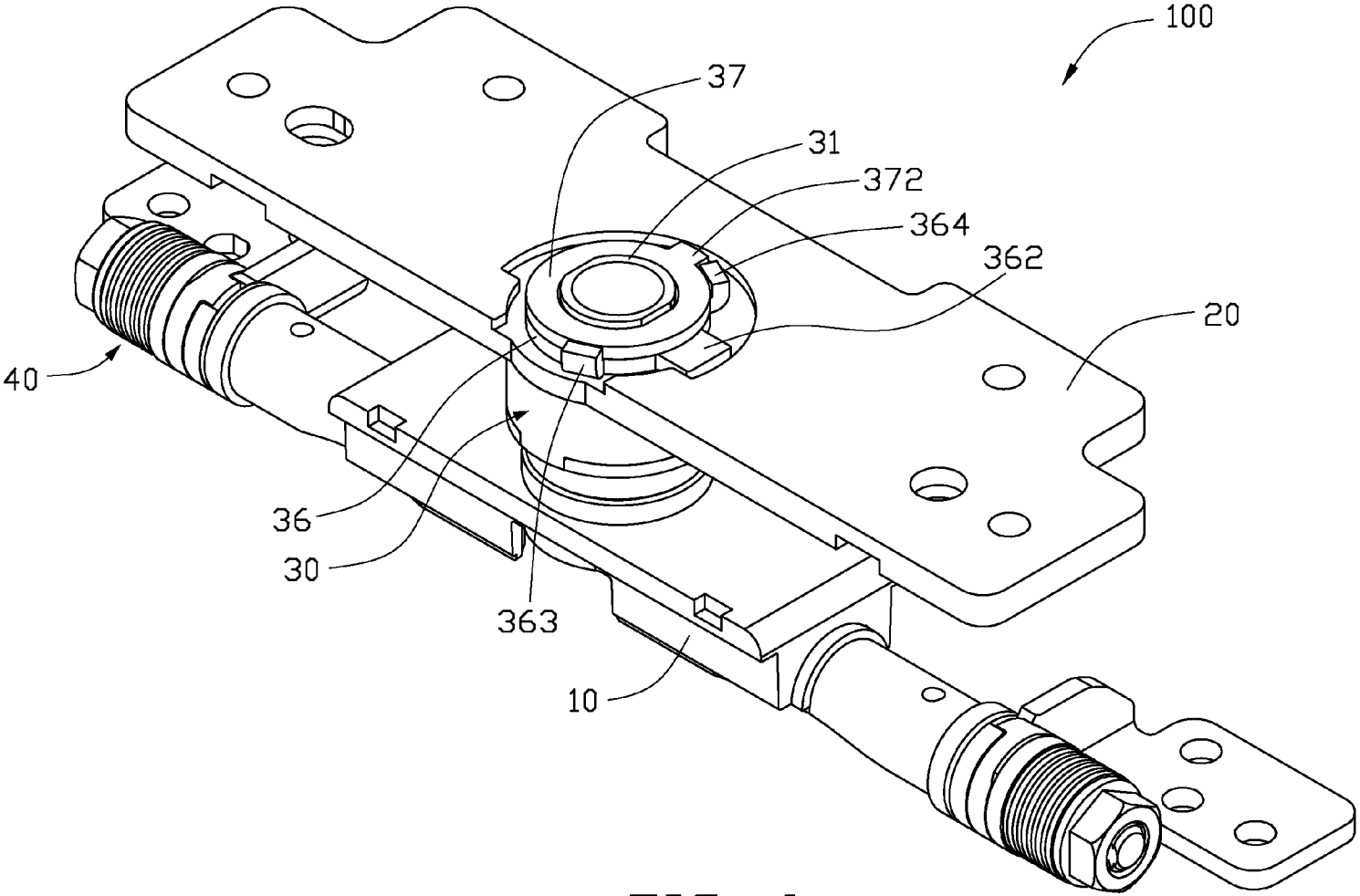
FIG. 6 is an isometric view of the hinge assembly of FIG. 5, but viewed from the same aspect as that of FIG. 4, and showing the state of the hinge assembly after the rotatable bracket has been further rotated another 180 degrees relative to the mounting bracket.

Referring to FIGS. 4 through 6, when the rotatable bracket 10 is rotated in a clockwise direction relative to the mounting bracket 20, the second restricting member 37 correspondingly rotates in the clockwise direction. When the rotatable bracket 10 is rotated 180 degrees in the clockwise direction relative to the mounting bracket 20, the restricting protrusion 372 of the second restricting member 37 correspondingly rotates 180 degrees and abuts against the second resisting portion 364 of the first restricting member 36. In this position, the protrusions of the second washer 35 once again engage in the positioning grooves 205 of the mounting bracket 20, so that the rotatable bracket 10 is stably held in position relative to the mounting bracket 20. When the rotatable bracket 10 is further rotated 180 degrees in the clockwise direction relative to the mounting bracket 20, the restricting protrusion 372 of the second restricting member 37 correspondingly rotates 180 degrees together with the second resisting portion 364 of the first restricting member 36. At that time, the restricting portion 362 of the first restricting member 36 reaches an end of the sliding groove 203, and the first restricting member 36 is blocked from rotating any further in the clockwise direction. Thus, the rotatable bracket 10 cannot rotate any further in the clockwise direction relative to the mounting bracket 20. In this position, the protrusions of the second washer 35 once again engage in the positioning grooves 205 of the mounting bracket 20, so that the rotatable bracket 10 is stably held in position relative to the mounting bracket 20. Thus, after the rotatable bracket 10 has rotated 360 degrees in the clockwise direction from an original position, the rotatable bracket 10 is stopped from rotating any further.

In exemplary use of the hinge assembly 100, the mounting bracket 20 is connected to a main body of an electronic device (not shown), and the two connecting frames 42 are connected to a cover of the electronic device. After that, the cover of the electronic device not only can pivot up and down relative to the main body, but also can rotate through 360 degrees relative to an axis of the rotating shaft 31 when the cover is in an opened state.

It should be pointed out that the first restricting member 36 may include only a single first restricting portion 363. In that case, the rotatable bracket 10 can rotate with the rotating shaft 31 through 540 degrees relative to the mounting bracket 20. The sliding groove 203 can have other shapes, such as a rectangle or a square. In addition, the second washer 35 may have more than two protrusions formed on the bottom surface thereof. In that case, more than two corresponding positioning grooves 205 may be formed at the top surface of the rotatable bracket 10.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A hinge assembly, comprising:

a mounting bracket defining a sliding groove;

a rotatable bracket;

a pivot mechanism positioned on the rotatable bracket; and a swivel mechanism connecting the rotatable bracket to the mounting bracket, the swivel mechanism comprising:

a rotating shaft;

a first restricting member rotatably connected to the rotating shaft, the first restricting member including a first restricting portion movably received in the sliding groove of the mounting bracket and a first resisting portion; and a second restricting member non-rotatably connected to the rotating shaft, the second restricting member comprising a restricting protrusion;

wherein when the rotating shaft is rotated, the restricting protrusion is capable of correspondingly rotating freely until it abuts the first resisting portion, whereupon the restricting protrusion is capable of driving the first resisting portion together with the first restricting member to rotate in the sliding groove until the restricting portion reaches an end of the sliding groove.

2. The hinge assembly of claim 1, wherein the first restricting member further comprises a second resisting portion, the first resisting portion and the second resisting portion are formed on opposite sides of the first restricting member.

3. The hinge assembly of claim 2, wherein the restricting protrusion radially extends from an outer edge of the second restricting member, the restricting protrusion is capable of resisting the first resisting portion or the second resisting portion, thus driving the first restricting member to rotate.

4. The hinge assembly of claim 3, wherein the sliding groove of the mounting bracket is substantially circular, and defines a peripheral portion that is substantially semicircular.

5. The hinge assembly of claim 1, wherein the rotating shaft comprises a shaft portion; a flange is formed on an first end of the shaft portion, and an assembling portion is formed on a opposite second end of the shaft portion; the first restricting member and the second restricting member are sleeved on the assembling portion.

6. The hinge assembly of claim 5, wherein an insertion portion is formed at a surface of the flange that is farthest away from the shaft portion, the mounting bracket is sleeved on the insertion portion.

7. The hinge assembly of claim 6, wherein the swivel mechanism further comprises a sleeve sleeved on the shaft portion.

8. The hinge assembly of claim 7, wherein the swivel mechanism further comprises a plurality of spring washers sleeved on the shaft portion and received in the sleeve.

9. The hinge assembly of claim 1, wherein the mounting bracket defines at least one positioning groove; the swivel mechanism comprises a washer sleeved on the rotating shaft; at least one protrusion extends from the washer and engaged with the at least one positioning groove of the rotatable bracket.

10. The hinge assembly of claim 1, wherein the rotatable bracket comprises a base portion and two connecting portions formed on opposite ends of the base portion; the hinge assembly further comprises two pivot mechanisms, and each pivot mechanism is connected to one corresponding connecting portion.

11. A hinge assembly, comprising:

a mounting bracket defining a sliding groove;

a rotatable bracket; and a rotating subassembly connecting the mounting bracket to the rotatable bracket, wherein the rotating subassembly comprises:

a rotating shaft;

a first restricting member rotatably connected to the rotating shaft, the first restricting member comprising a first restricting portion, the first restricting portion movably received in the sliding groove of the mounting bracket; and a second restricting member non-rotatably connected to the rotating shaft; and upon rotation of the rotating shaft capable of driving the first restricting member to move so that the restricting portion of the first restricting member slides in the sliding groove of the mounting bracket.

12. The hinge assembly of claim 11, wherein the first restricting member further comprises a first resisting portion and a second resisting portion, the first resisting portion and the second resisting portion are formed on opposite sides of the first restricting member.

13. The hinge assembly of claim 12, wherein a restricting protrusion radially extends from an outer edge of the second restricting member, the restricting protrusion is capable of resisting the first resisting portion or the second resisting portion, thus driving the first restricting member to rotate.

14. The hinge assembly of claim 13, wherein the sliding groove of the mounting bracket is substantially circular, and defines a peripheral portion that is substantially semicircular.

15. The hinge assembly of claim 11, wherein the rotating shaft comprises a shaft portion; a flange is formed on an first end of the shaft portion, and an assembling portion is formed on a opposite second end of the shaft portion; the first restricting member and the second restricting member are sleeved on the assembling portion.

16. The hinge assembly of claim 15, wherein an insertion portion is formed at a surface of the flange that is farthest away from the shaft portion, the mounting bracket is sleeved on the insertion portion.

* * * * *